US011817645B2

(12) United States Patent
Xie et al.

(10) Patent No.: US 11,817,645 B2
(45) Date of Patent: Nov. 14, 2023

(54) CARD EDGE CONNECTOR HAVING AN INSULATIVE HOUSING WITH RECESSED PORTIONS ON OUTER SURFACES THEREOF

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Ce-En Xie, Kunshan (CN); Zhuang-Xing Li, Kunshan (CN); Wen-Jun Tang, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 19 days.

(21) Appl. No.: 17/540,405

(22) Filed: Dec. 2, 2021

(65) Prior Publication Data

US 2022/0181809 A1 Jun. 9, 2022

(30) Foreign Application Priority Data

Dec. 3, 2020 (CN) ..... 202022880522.9

(51) Int. Cl.

| | |
|---|---|
| ***H01R 12/72*** | (2011.01) |
| ***H01R 13/516*** | (2006.01) |
| ***H01R 13/629*** | (2006.01) |

(52) U.S. Cl.
CPC ..... *H01R 12/721* (2013.01); *H01R 13/516* (2013.01); *H01R 13/629* (2013.01)

(58) Field of Classification Search
CPC ... H01R 12/721; H01R 13/516; H01R 13/629
USPC ..... 439/630
See application file for complete search history.

(56) References Cited

U.S. PATENT DOCUMENTS 5,820,392 A * 10/1998 Lin ..... H01R 12/721 439/60
6,033,236 A * 3/2000 McHugh ..... H01R 13/658 439/74
6,042,398 A * 3/2000 Wu ..... H01R 13/655 439/101

(Continued)

FOREIGN PATENT DOCUMENTS

CN 110797713 A 2/2020

*Primary Examiner* — Peter G Leigh
(74) *Attorney, Agent, or Firm* — Ming Chieh Chang

(57) ABSTRACT

A card edge connector includes: an elongated insulative housing comprising two longitudinal walls, a center slot defined between the longitudinal walls, and plural terminal receiving passageways arranged along the longitudinal walls; and plural terminals fixed in the terminal receiving passageways, wherein each of the longitudinal walls defines a first recessed portion extending along a longitudinal direction and plural second recessed portions extending upwardly from the first recessed portion at an outer surface thereof, the second recessed portions are arranged at intervals along the longitudinal direction, the first recessed portion goes through a bottom face of the longitudinal wall, and the second recessed portions does not go through a top of the longitudinal wall.

11 Claims, 8 Drawing Sheets

(56) References Cited

U.S. PATENT DOCUMENTS

| | | | | |
|---|---|---|---|---|
| 7,008,267 | B2 * | 3/2006 | Fan | H01R 13/658 439/108 |
| 7,445,502 | B2 * | 11/2008 | Zhang | H01R 12/707 439/733.1 |
| 7,578,701 | B2 * | 8/2009 | Hsu | H01R 13/6594 439/607.34 |
| 7,731,541 | B1 * | 6/2010 | Lee | H01R 12/716 439/660 |
| 8,215,994 | B2 * | 7/2012 | Duenas | H01R 13/6471 439/637 |
| 8,444,424 | B2 * | 5/2013 | Shen | H01R 12/721 439/153 |
| 9,022,809 | B2 * | 5/2015 | Tang | H01R 12/721 439/637 |
| 9,270,063 | B2 | 2/2016 | Hai | |
| 9,853,403 | B1 * | 12/2017 | Chen | H01R 24/60 |
| 10,193,253 | B2 * | 1/2019 | Li | H01R 12/83 |
| 10,224,653 | B2 * | 3/2019 | Niu | H01R 12/721 |
| 10,490,920 | B2 * | 11/2019 | Manickam | H01R 13/648 |
| 10,797,450 | B2 * | 10/2020 | Chen | H01R 13/6581 |
| 2008/0050973 | A1 * | 2/2008 | Biddle | H01R 12/721 439/637 |
| 2014/0193992 | A1 * | 7/2014 | Fang | H01R 13/6594 439/345 |
| 2019/0190212 | A1 * | 6/2019 | Fang | H01R 13/646 |
| 2019/0237884 | A1 * | 8/2019 | Wang | H01R 12/721 |
| 2019/0393634 | A1 * | 12/2019 | Kao | H01R 13/6471 |

* cited by examiner

CARD EDGE CONNECTOR HAVING AN INSULATIVE HOUSING WITH RECESSED PORTIONS ON OUTER SURFACES THEREOF

BACKGROUND OF THE INVENTION

1. Field of the Invention

The invention relates to a card edge connector having an insulative housing with recessed portions on outer surfaces thereof.

2. Description of Related Art

During injection molding an insulative housing of a card edge connector, warpage of the insulative housing may occur due to its long length, resulting in a smile-like bend such that the insulative housing may not be properly soldered to a printed circuit board.

It is desired to have a card edge connector overcoming the warpage problem.

SUMMARY OF THE INVENTION

To achieve the above desire, a card edge connector comprises: an elongated insulative housing comprising two longitudinal walls, a center slot defined between the longitudinal walls, and a plurality of terminal receiving passageways arranged along the longitudinal walls; and a plurality of terminals fixed in the terminal receiving passageways; wherein each of the longitudinal walls defines a first recessed portion extending along a longitudinal direction and a plurality of second recessed portions extending upwardly from the first recessed portion at an outer surface thereof, the second recessed portions are arranged at intervals along the longitudinal direction, the first recessed portion goes through a bottom face of the longitudinal wall, and the second recessed portions does not go through a top of the longitudinal wall.

DETAILED DESCRIPTION OF THE PREFERRED EMBODIMENT

Figure 1:
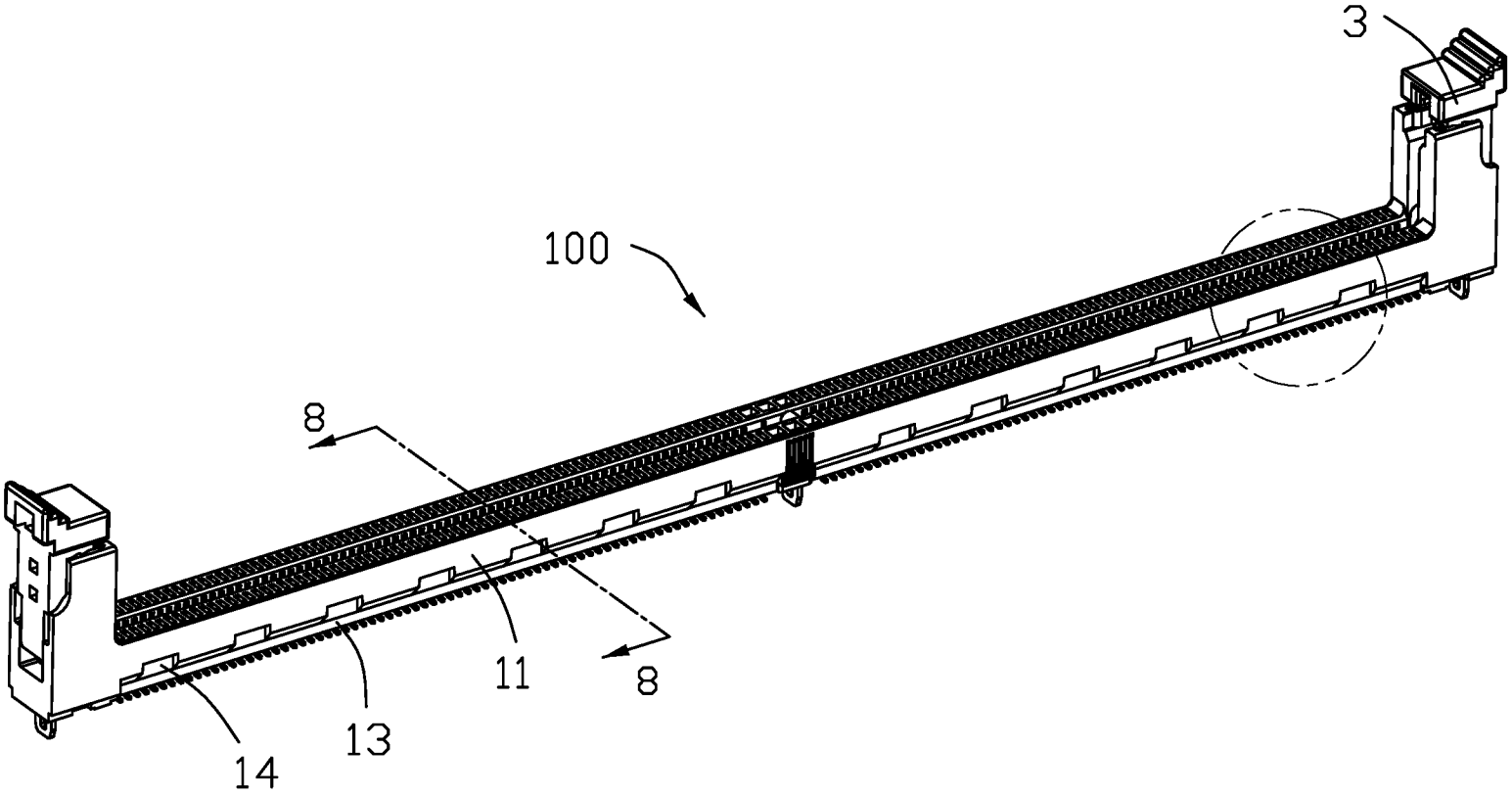
FIG. 1 is a perspective view of a card edge connector according to a preferred embodiment of the invention.
Figure 2:
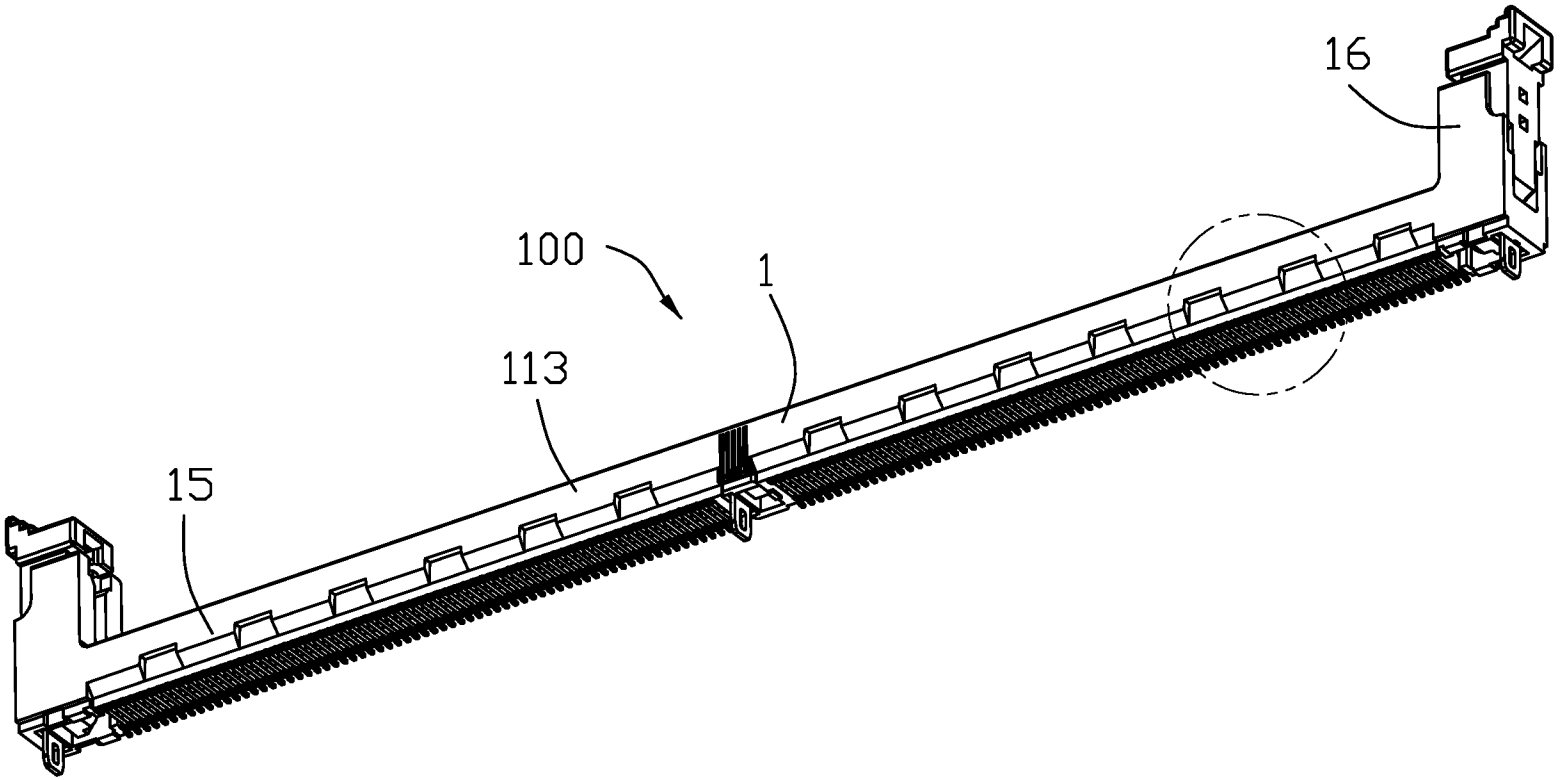
FIG. 2 is another perspective view of the card edge connector of FIG. 1.
Figure 3:
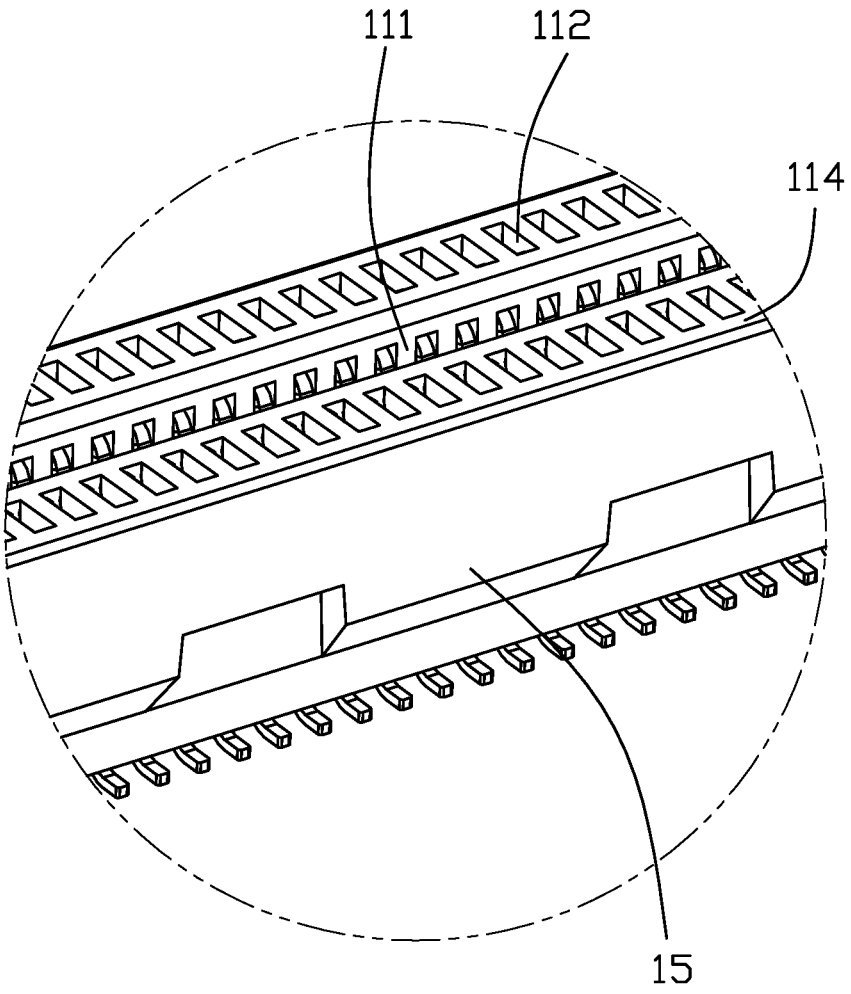
FIG. 3 is an enlarged perspective view of a circled part of the card edge connector of FIG. 1.
Figure 4:
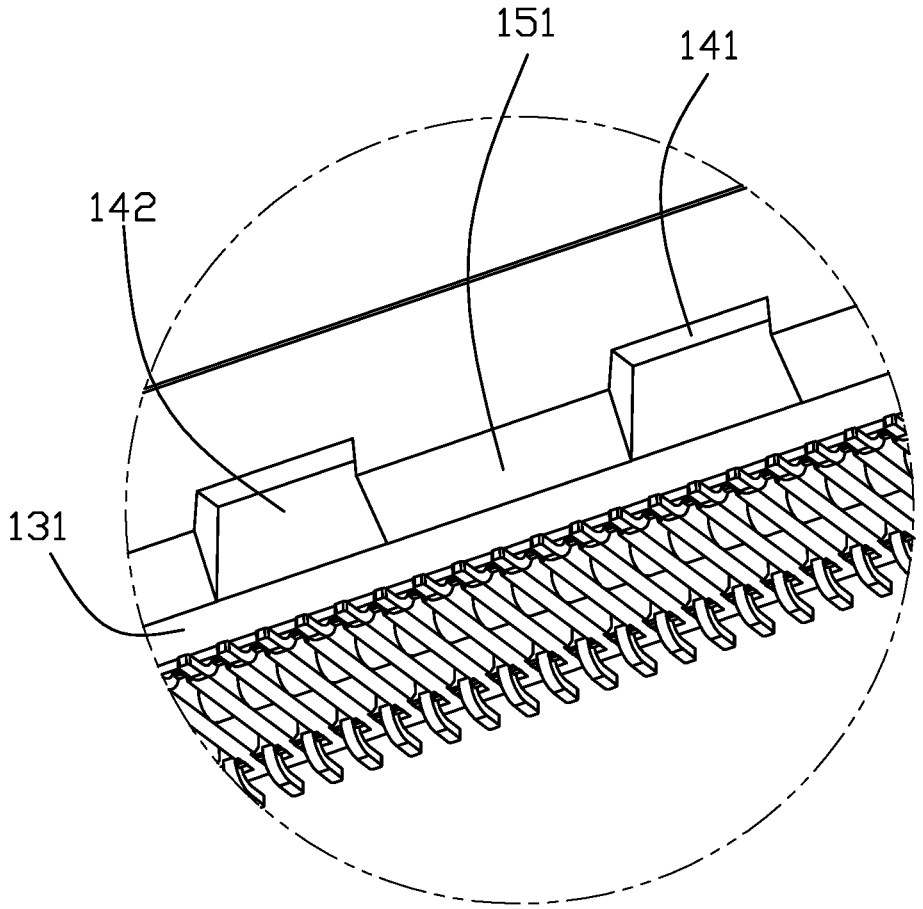
FIG. 4 is an enlarged perspective view of a circled part of the card edge connector of FIG. 2.
Figure 5:
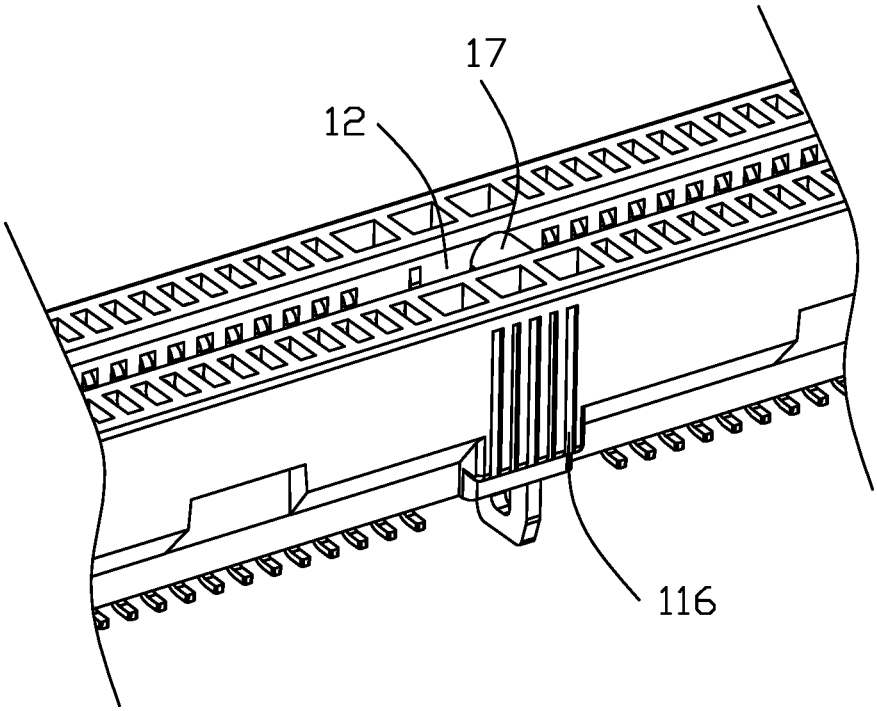
FIG. 5 is a perspective view of a middle part of the card edge connector of FIG. 1.

Reference will now be made in detail to the preferred embodiment of the present invention.

Referring to FIGS. 1-8, a card edge connector 100 adapted for receiving a module card includes an elongated housing 1 made from insulative material and a plurality of terminals 2. The insulative housing 1 includes two side longitudinal walls 11 and a center slot 12 located between the two longitudinal walls 11. The longitudinal wall 11 includes a plurality of terminal receiving passageways 112 to receive the terminal 2 on an inner surface 111 thereof. The longitudinal wall 11 defines a first recessed portion 13 extending longitudinally and a plurality of second recessed portions 14 extending upwardly from the first recessed portion 13 on an outer surfaces 113 of the longitudinal wall. The plurality of second recessed portions 14 are arranged at intervals along the longitudinal direction. The first recessed portion 13 goes through the bottom surface of each longitudinal wall 11, and the second recessed portion 14 does not go through the top surface 114 of the longitudinal wall 11. In this way, each longitudinal wall 11 of the insulative housing 1 is divided into two parts with different thicknesses in an upper and down direction. As a result, the two parts have different shrinkage rates due to thermal expansion and contraction during the injection molding process of the insulative housing 1, which reduces the amount of warpage housing and prevents smile-shaped warping.

The first recessed portion 13 continues from one end to another end of the insulative housing 1 along the longitudinal direction except a middle part with the key 17. A spaced rib 15 is formed between two adjacent second recessed portions 14. The spaced ribs 15 have an inclined bottom face 151 and all the bottom face 151 are in one inclined plane. The upper edge of the inclined bottom face 151 is located lower than a ceiling face 141 of the second recessed portion 14. The spaced ribs 15 may also be directly arranged in a step shape in alternative embodiment.

Figure 6:
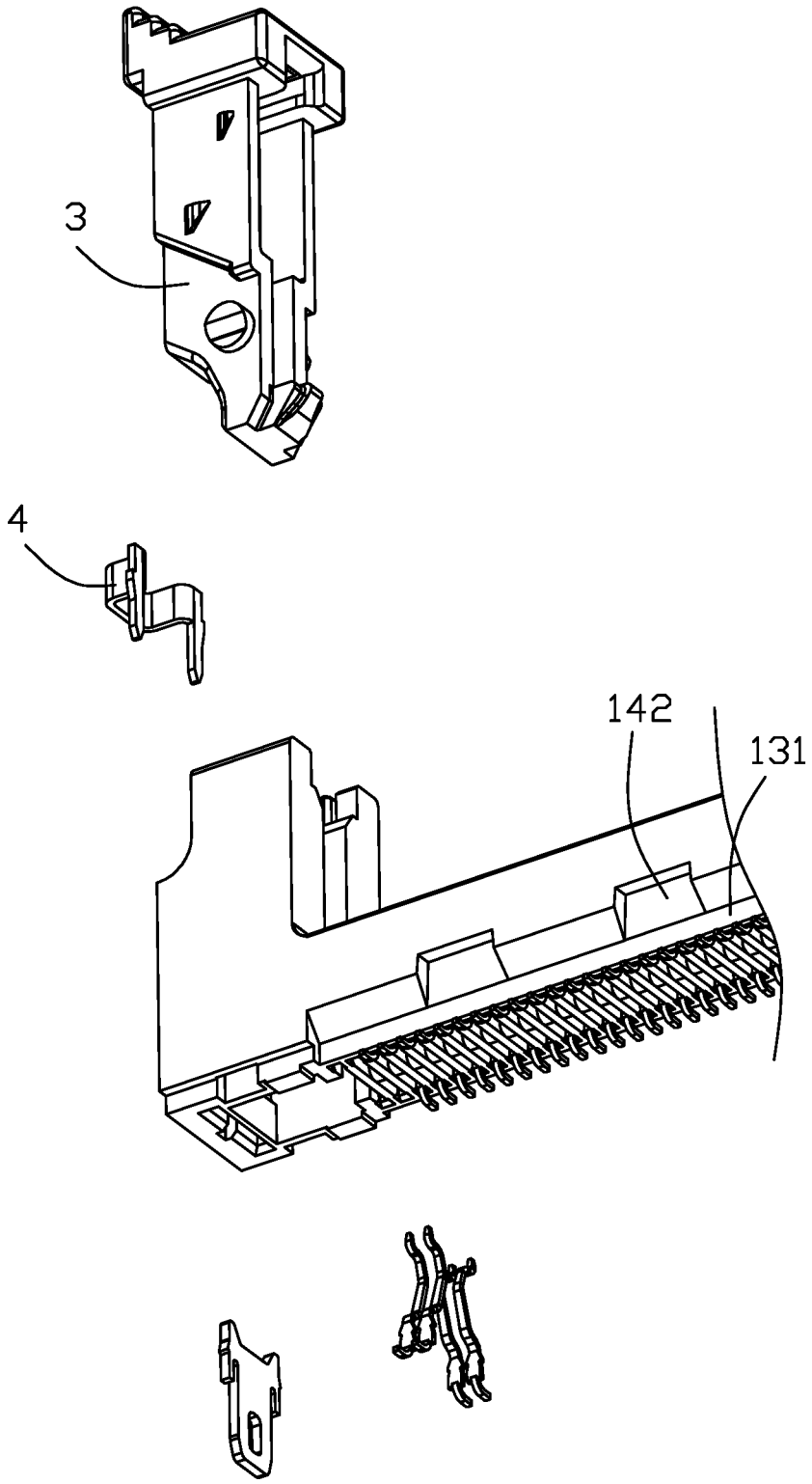
FIG. 6 is an exploded perspective view of left end of the card edge connector of FIG. 2.
Figure 7:
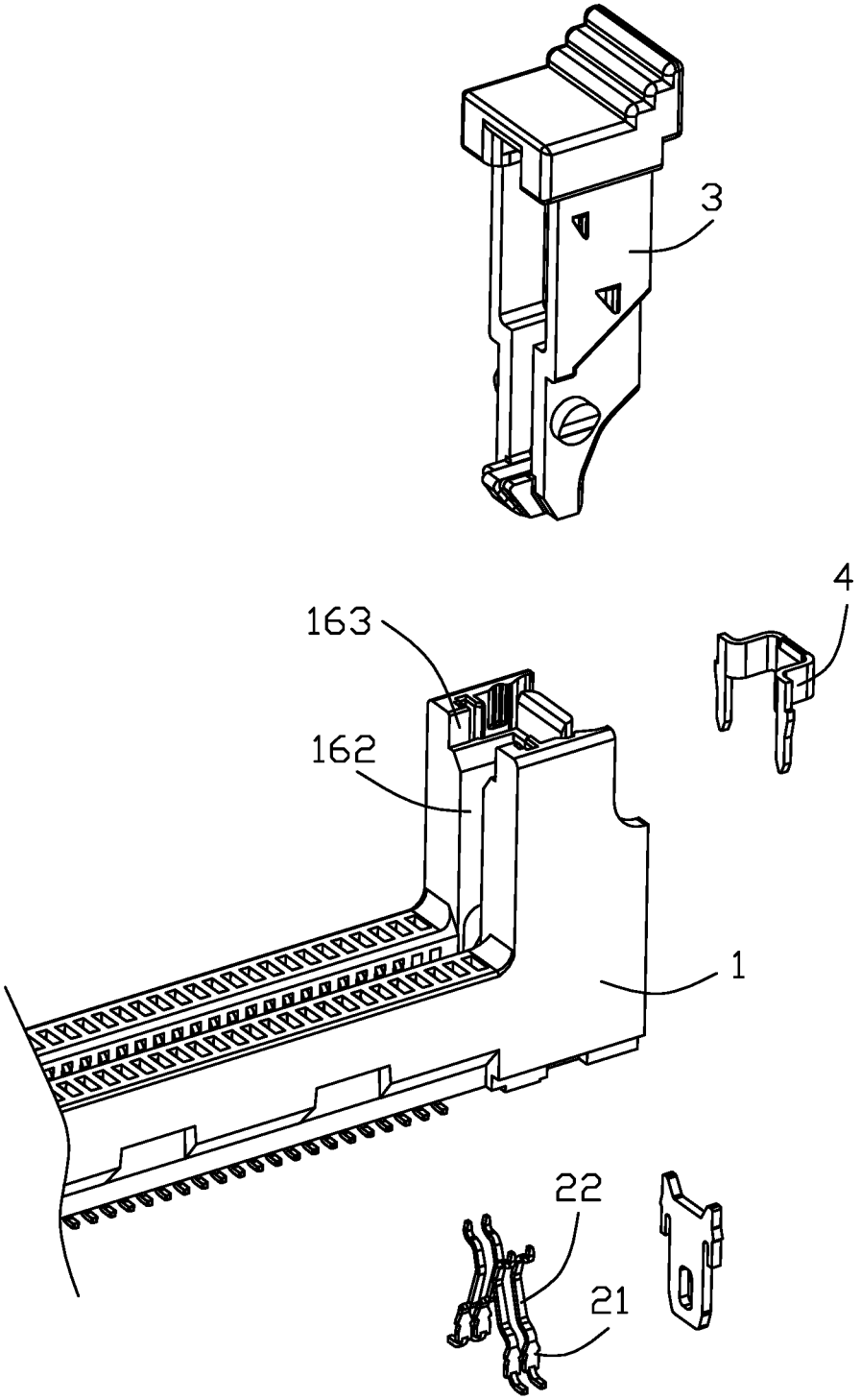
FIG. 7 is an exploded perspective view of right end of the card edge connector of FIG. 1.
Figure 8:
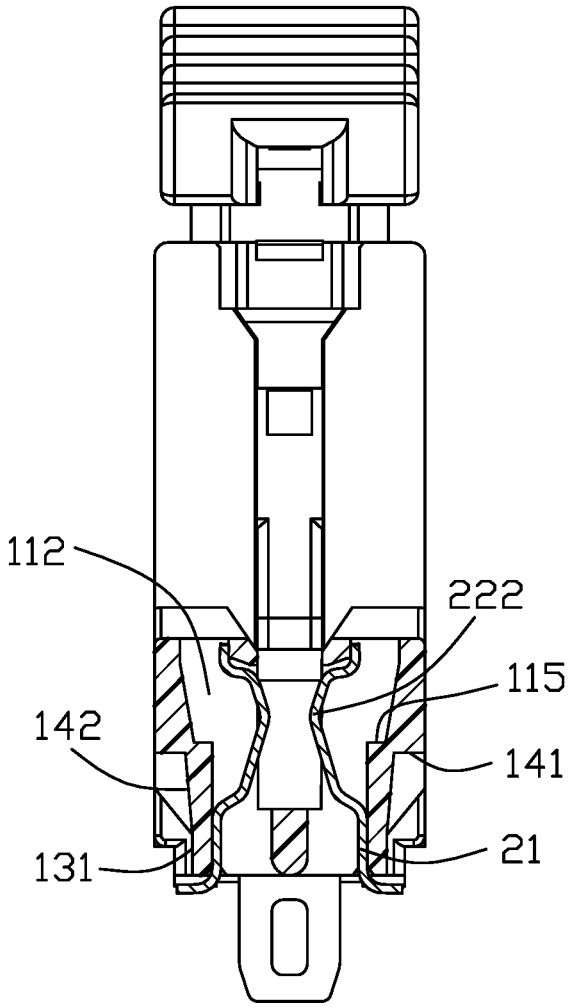
FIG. 8 is a cross-sectional view of the card edge connector taken along broken lines 8-8 in FIG. 1.

Referring to FIGS. 6-7, the insulative housing 1 has two tower portions 16 protruding upwardly from two opposite ends of the insulative housing 1. The bottom face 151 extends along the longitudinal direction until at a point just below corresponding tower portion 16. The card edge connector 100 has a pair of ejectors 3 assembled to the tower portions 16. The top of the tower portion 16 is recessed with a fixing groove 161, and a metal U-shaped piece 4 is inserted into the fixing groove 161. The terminal receiving passageway 112 defines a stepped face 115 facing inwardly, and the ceiling face 141 of the second recessed portion 14 is located lower than the stepped face 115. The terminal 2 includes a vertical fixing portion 21 and an elastic portion 22 inwardly extending obliquely from the fixing portion 21. The elastic portion 22 has a contacting point 222 in the center slot 12. The fixing portion 21 extends upwardly with a top point located above the first recessed portion 13 while below the ceiling face 141 of the second recessed portion 14. Referring to FIG. 7, the tower portion 16 defines a slot 162 connected with the center slot 12 and a notch 163 at opposite sides of upper portions of the slot 162. The ceiling faces 141 of the second recessed portions 14 facing downward are located below the contacting points 222 of the terminals 2.

The insulative housing 1 includes a key 17 connected with the two longitudinal walls 11. The longitudinal wall 11 defines a plurality of vertical slots 116 adjacent to the key 17. The plurality of vertical slots 116 are densely arranged but spaced apart from each other in the longitudinal direction. Because of a large thickness of the longitudinal wall 11 adjacent to the key 17, it is easily shrink and produce small pits during injection molding, which will affect an appearance of the insulative housing. The vertical slots 116 can avoid forming the pits.

In this embodiment, along a lateral view perpendicular to the longitudinal wall 11, the second recessed portion 14 is of a trapezoidal shape which is convenient for demolding treatment after injection molding, and avoid damaging the insulative housing 1. The side face 142 facing outwards of the second recessed portion 14 is inclined, and the side face 131 facing outwards of the first recessed portion 13 is upright. The terminals 2 include SMT leg portions formed by bending and extending outwardly from the fixing portions 21. In other embodiments, the second recessed portion 14 can also be arranged in a triangle, rectangle, square, or rhombus pattern, and the side face 142 of the second recessed portion 14 can also be arranged in a plane parallel to the side face 131 of the first recessed portion 13.

What is claimed is:

1. A card edge connector comprising:

an elongated insulative housing comprising two longitudinal walls, a center slot defined between the longitudinal walls, and a plurality of terminal receiving passageways arranged along the longitudinal walls; and a plurality of terminals fixed in the terminal receiving passageways;

wherein each of the longitudinal walls defines a first recessed portion extending along a longitudinal direction and a plurality of second recessed portions extending upwardly from the first recessed portion at an outer surface thereof, the second recessed portions are arranged at intervals along the longitudinal direction, the first recessed portion goes through a bottom face of the longitudinal wall, and the second recessed portions does not go through a top of the longitudinal wall; and wherein the second recessed portion has a trapezoidal shape as viewed perpendicular to the longitudinal wall.

2. The card edge connector as claimed in claim 1, wherein the first recessed portion extends from one end of longitudinal wall to another end of the longitudinal walls along the longitudinal direction.

3. The card edge connector as claimed in claim 1, wherein a rib is formed between every two adjacent second recessed portions, and each rib has an inclined bottom face, an upper edge of the inclined bottom face is located lower than a ceiling face of the second recessed portion.

4. The card edge connector as claimed in claim 3, wherein the insulative housing comprises two tower portions protruding upwardly from two opposite ends of the longitudinal walls, and the first recessed portions extend to a point below corresponding tower portions.

5. The card edge connector as claimed in claim 4, wherein the terminal receiving passageway defines a stepped face facing inwardly and upwardly, and the ceiling face of the second recessed portion is located lower than the stepped face.

6. The card edge connector as claimed in claim 4, wherein the tower portion defines a slot connecting with the center slot and a notch at opposite sides of the slot.

7. The card edge connector as claimed in claim 1, wherein the terminals include vertical fixing portions and elastic portions extending obliquely from the fixing portions, and the fixing portion extends upwardly with a top end thereof beyond the first recessed portion while below the ceiling face of the second recessed portion.

8. The card edge connector as claimed in claim 7, wherein the terminals comprise surface-mounted leg portions formed by bending and extending outwardly from the fixing portions.

9. The card edge connector as claimed in claim 1, wherein the insulative housing includes a key connected with the two longitudinal walls, and each of the two longitudinal walls defines a plurality of vertical slots adjacent to the key.

10. The card edge connector as claimed in claim 9, wherein an outer face facing outward of the second recessed portion is inclined, and an outer face facing outward of the first recessed portion is flat.

11. A card edge connector comprising:

an elongated insulative housing comprising two longitudinal walls, a center slot defined between the longitudinal walls, and a plurality of terminal receiving passageways arranged along the longitudinal walls; and a plurality of terminals fixed in the terminal receiving passageways; wherein each of the longitudinal walls defines a first recessed portion extending along a longitudinal direction and a plurality of second recessed portions extending upwardly from the first recessed portion at an outer surface thereof, the second recessed portions are arranged at intervals along the longitudinal direction, the first recessed portion goes through a bottom face of the longitudinal wall, and the second recessed portions does not go through a top of the longitudinal wall;

the insulative housing includes a key connected with the two longitudinal walls, and each of the two longitudinal walls defines a plurality of vertical slots adjacent to the key; and an outer face facing outward of the second recessed portion is inclined, and an outer face facing outward of the first recessed portion is flat.

* * * * *